US006061834A

United States Patent [19]

Liao

[11] Patent Number: 6,061,834

[45] Date of Patent: May 16, 2000

[54] AIR VENTILATION SAFETY HELMET

[76] Inventor: Cheng-An Liao, No. 20, Lane 112, Jen-Ai Rd., Lin-Kou Country, Taipei Hsien, Taiwan

[21] Appl. No.: 09/332,332

[22] Filed: Jun. 14, 1999

[51] Int. Cl.[7] ..... A42B 3/28

[52] U.S. Cl. ..... 2/171.3; 2/411

[58] Field of Search ..... 2/410, 411, 422, 2/424, 425, 171.3, 171.4, 184.5

[56] References Cited

U.S. PATENT DOCUMENTS

| | | | |
|---|---|---|---|
| 482,429 | 9/1892 | O'Connor | 2/184.5 |
| 3,496,354 | 2/1970 | Feldmann et al. | 2/410 |
| 5,086,520 | 2/1992 | Arai | 2/424 |
| 5,345,614 | 9/1994 | Tanaka | 2/425 |

FOREIGN PATENT DOCUMENTS

| | | | |
|---|---|---|---|
| 252243 | 1/1988 | European Pat. Off. | 2/410 |
| 268549 | 5/1988 | European Pat. Off. | 2/410 |
| 320622 | 6/1989 | European Pat. Off. | 2/410 |
| 3822252 | 1/1990 | Germany | 2/410 |

*Primary Examiner*—Michael A. Neas

[57] ABSTRACT

An air ventilation safety helmet includes a molded helmet and an air funnel which can be attached to the molded helmet by using a rubber band, a spring, a screw, or the like. In the front of the air funnel, there is an air inlet through which the air can flow into the helmet. Inside the liner of the molded helmet, there are several air ducts directed to the air funnel so that the air can flow through the air ducts to provide good air ventilation. When it rains or it is cold, the air funnel can be rotated to prevent the cold air from flowing into the helmet and to avoid water leakage.

10 Claims, 10 Drawing Sheets

FIG.1 PRIOR ART

AIR VENTILATION SAFETY HELMET

FIELD OF THE INVENTION

The present invention relates generally to a helmet for cooling the scalp and more particularly to a helmet with a ventilation device which is comfortable to wear and waterproof.

BACKGROUND OF THE INVENTION

Nowadays, in many countries, helmets to protect motorcyclists are required when people ride in motorcycles. Thus, the development of the safety helmet design becomes more and more important. As shown in FIG. 1, the helmet ventilation device described in the previous art has two ventilation slits on the front surface so that the air can flow into the helmet. However, since the interior of the helmet is fully occupied by the head of the wearer, the air can only reach the forehead, not the entire scalp. Hence, such poor air ventilation often results in intolerable overheating of the scalp, especially in summer time. Moreover, although such ventilation slits are equipped with a device to avoid water leakage, the device usually fails to function normally. When it rains, the rain can easily leak into the helmet through the ventilation slits causing discomfort.

Based on the findings of the aforementioned drawbacks, it is therefore desirable to introduce an improved helmet ventilation device not only to provide good air ventilation and to avoid water leakage but also to make wearers more comfortable.

SUMMARY OF THE INVENTION

The primary object of the present invention is to provide an air ventilation helmet comprising a helmet and an air ventilation device which increases the air flow into the helmet and thus enhances the air ventilation and the heat dissipation thereof.

It is also an object of the present invention to provide a helmet having air conducting means formed inside the liner thereof. The air conducting means comprises several air conducting channels directed to the ventilation device. Hence, the air can flow through the air ventilation device and into the helmet through the air ducts so as to provide good ventilation.

It is another object of the present invention to provide an air ventilation device that can be rotated to the back to prevent the cold air from flowing into the helmet in winter and to avoid water leakage when it rains.

To achieve the aforementioned objects, there is provided an air ventilation safety helmet comprising a molded helmet body defining a recessed interior for receiving therein the head of the motorcyclist and an air funnel which is attached to the molded helmet by means of a rubber band, a spring, a screw, or the like. Further, directed to the air funnel, several air ducts are formed inside the liner of the molded helmet to allow air to flow therethrough.

These and other objects and advantages of the present invention will become more apparent from a consideration of the following detailed description of a preferred embodiment thereof, when read in conjunction with the accompanying drawings, wherein:

DETAILED DESCRIPTION OF THE PREFERRED EMBODIMENT

Figure 1:
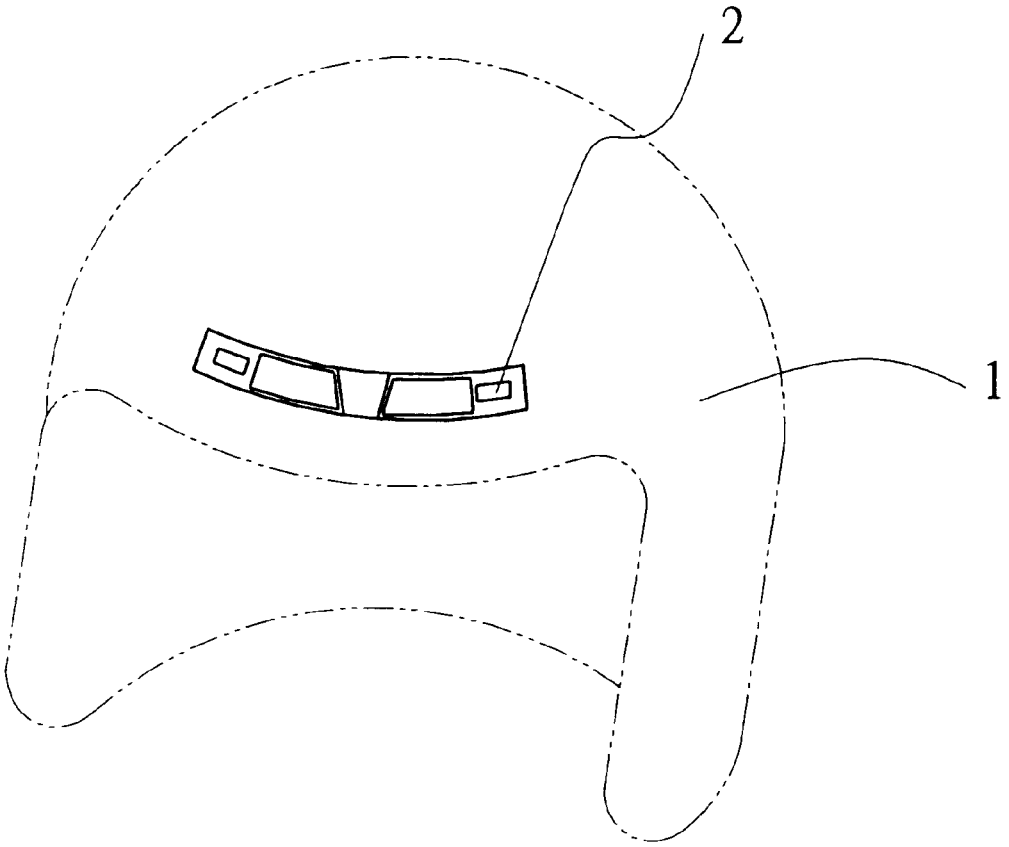
FIG. 1 shows a helmet with a ventilation device described in the previous art.
Figure 2:
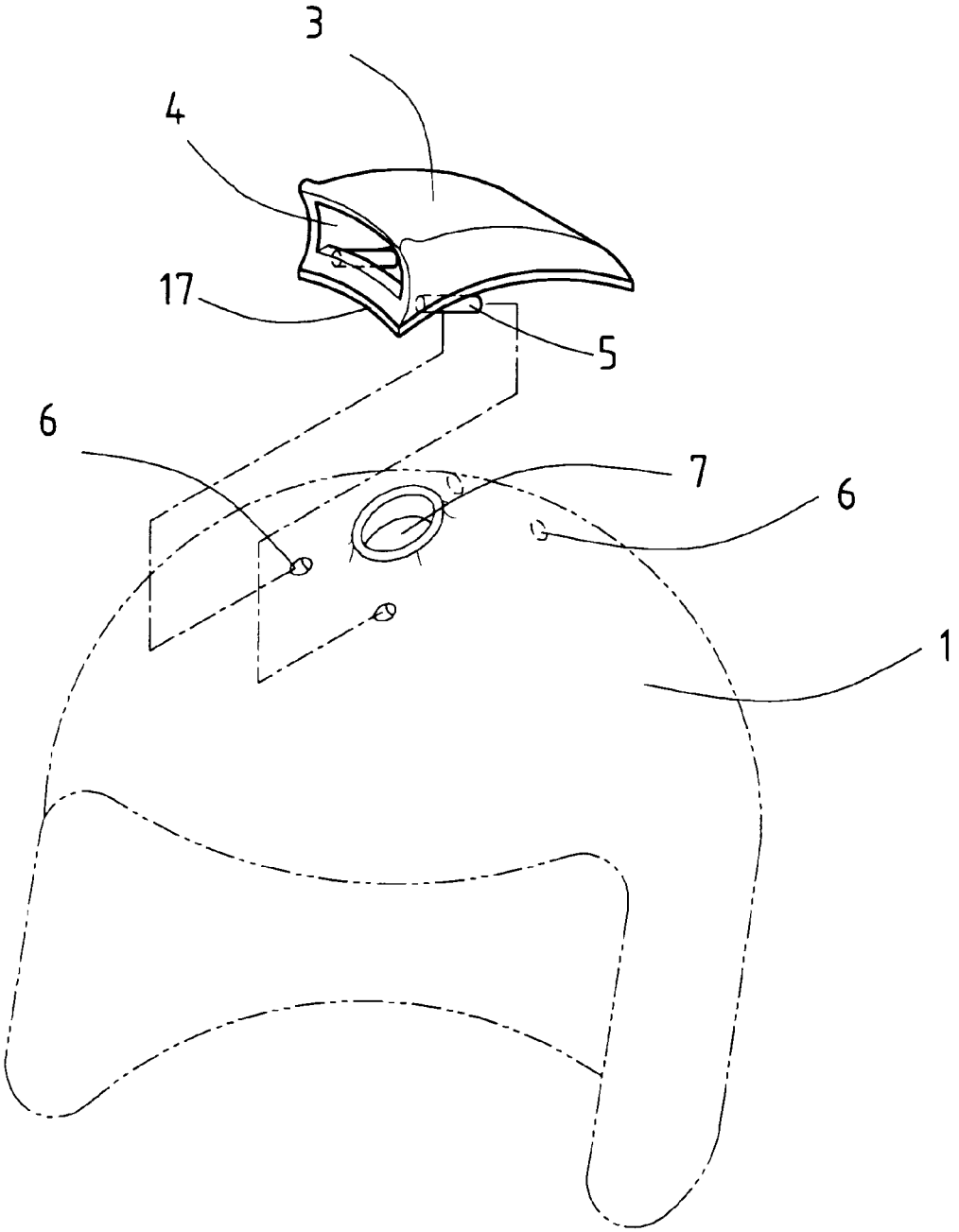
FIG. 2 shows the parts of the present invention.

Referring to FIG. 2, an air ventilation safety helmet constructed in accordance with the present invention comprises an air funnel 3 and a molded helmet 1 in which the air funnel 3 has a air inlet 4 and clamping rods 5 beside the air inlet 4. On the molded helmet, there are air conducting hole 7 and two pairs of clamping grooves 6. A user can attach the air funnel 3 to the molded helmet by inserting the clamping rods 5 on the air funnel 3 into either the front pair of the clamping grooves or the rear pair of the clamping grooves 6. Further the air funnel 3 is installed with a leakage proof pad 17 which can not only avoid the water leakage but also reduce the noise resulting from the attachment between the helmet 1 and the air funnel 3.

Figure 3:
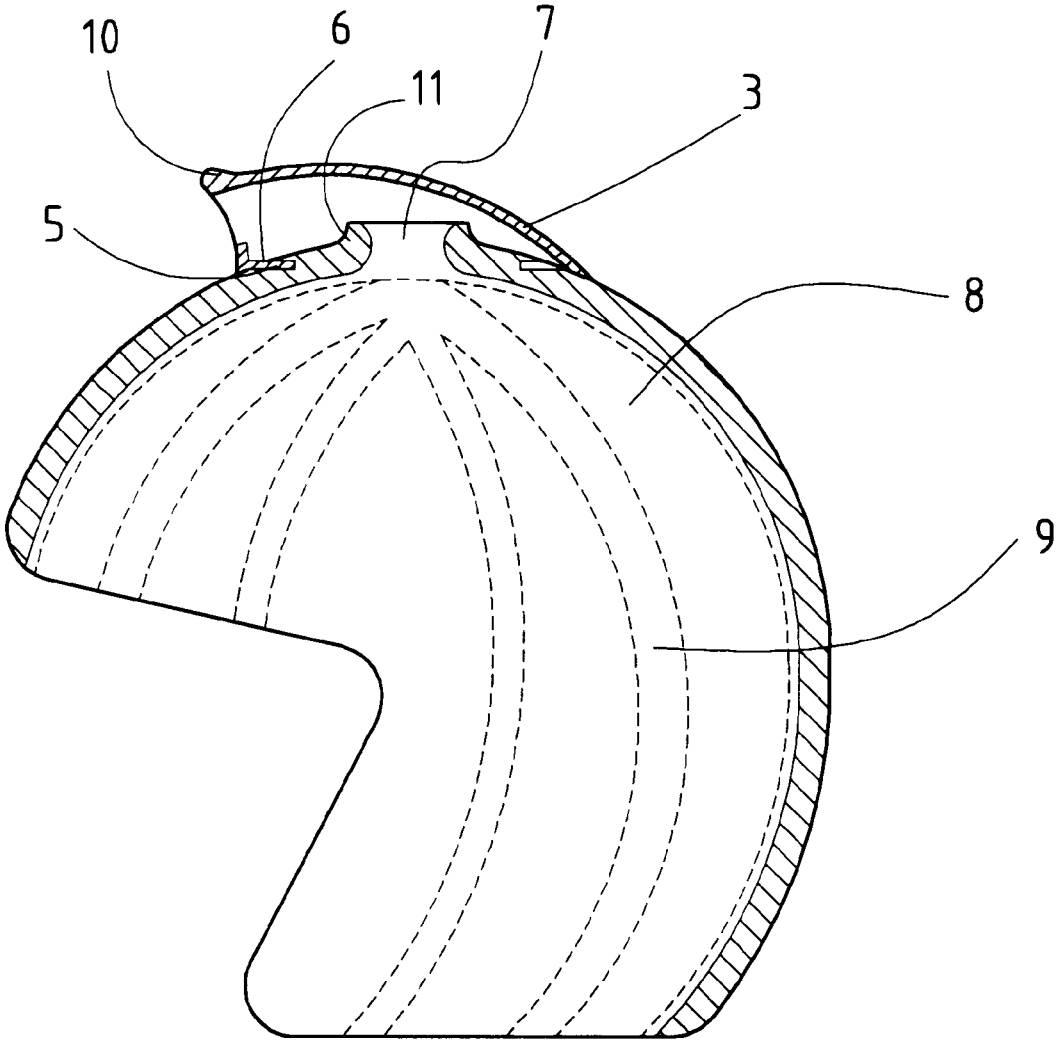
FIG. 3 shows the first preferred embodiment of the present invention in which the air funnel faces forward and is attached to the molded helmet by means of clamps.
Figure 4:
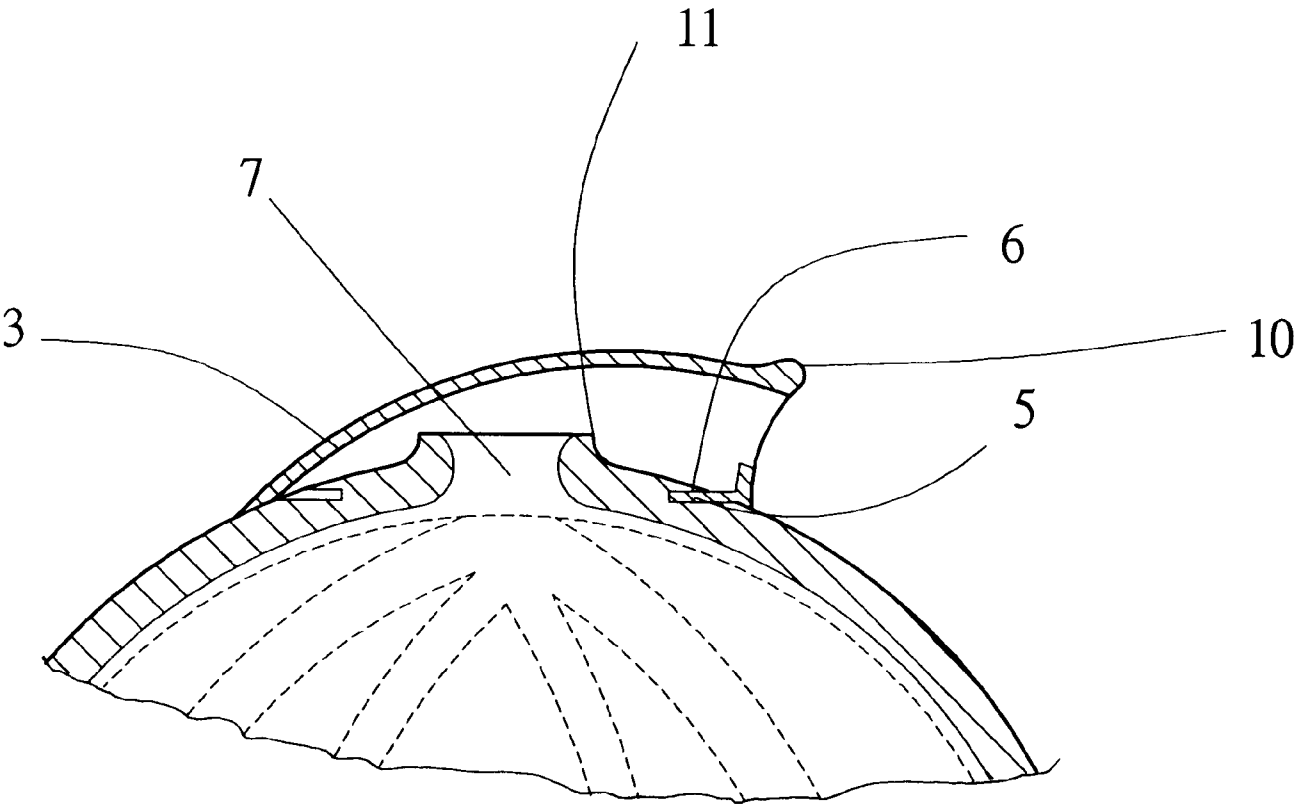
FIG. 4 shows the first preferred embodiment of the present invention in which the air funnel faces backward and is attached to the molded helmet by means of clamps.

According to FIG. 3, when the temperature is high or the heat inside the helmet needs to be dissipated, the air funnel 3 is attached to the helmet 1 by inserting the clamping rods 5 into the front pair of the grooves 6 so that the air funnel faces forward and allow the air to flow through the inlet 4. Further, inside the shock-absorbing liner 8 of the helmet 1, there are several air ducts 9 which are directed to the air conducting hole 7 so that the air can flow through the inlet 4, the conducting hole 7 and the air ducts 9 to provide good air ventilation. On the other hand, when it is raining or is cold, a user can assemble the helmet by inserting the corresponding clamping rods 5 into the rear pair of the grooves 6 as shown in FIG. 4 so that the air funnel faces backward to prevent the air from flowing into the helmet. It can be also observed in FIG. 3, that there are extended parts 10, 11 on the air funnel 3 and the conducting hole 7, respectively, which are designed to prevent water from leaking into the helmet.

Figure 5:
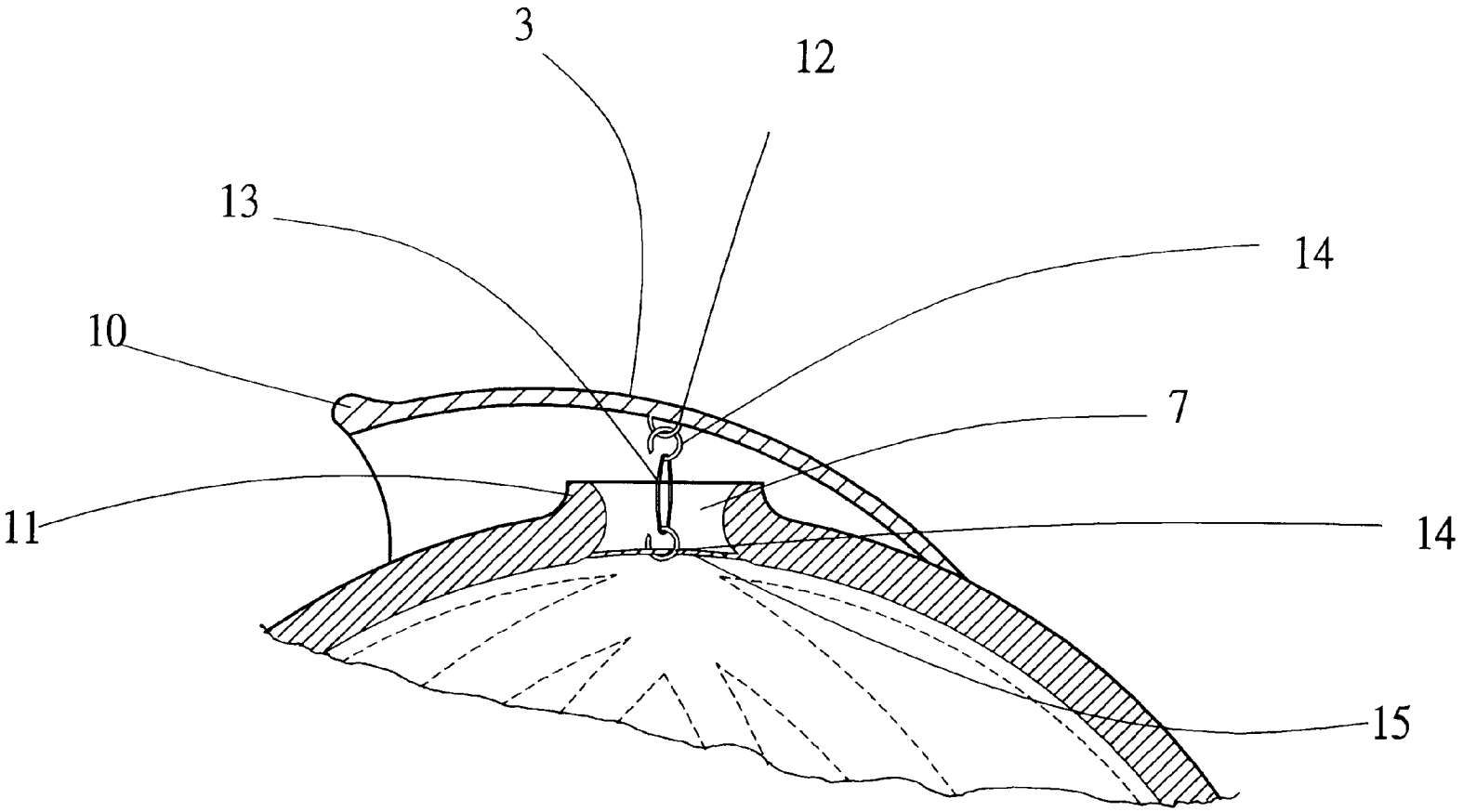
FIG. 5 shows the second preferred embodiment of the present invention in which the air funnel faces forward and is attached to the molded helmet by means of a rubber band.
Figure 6:
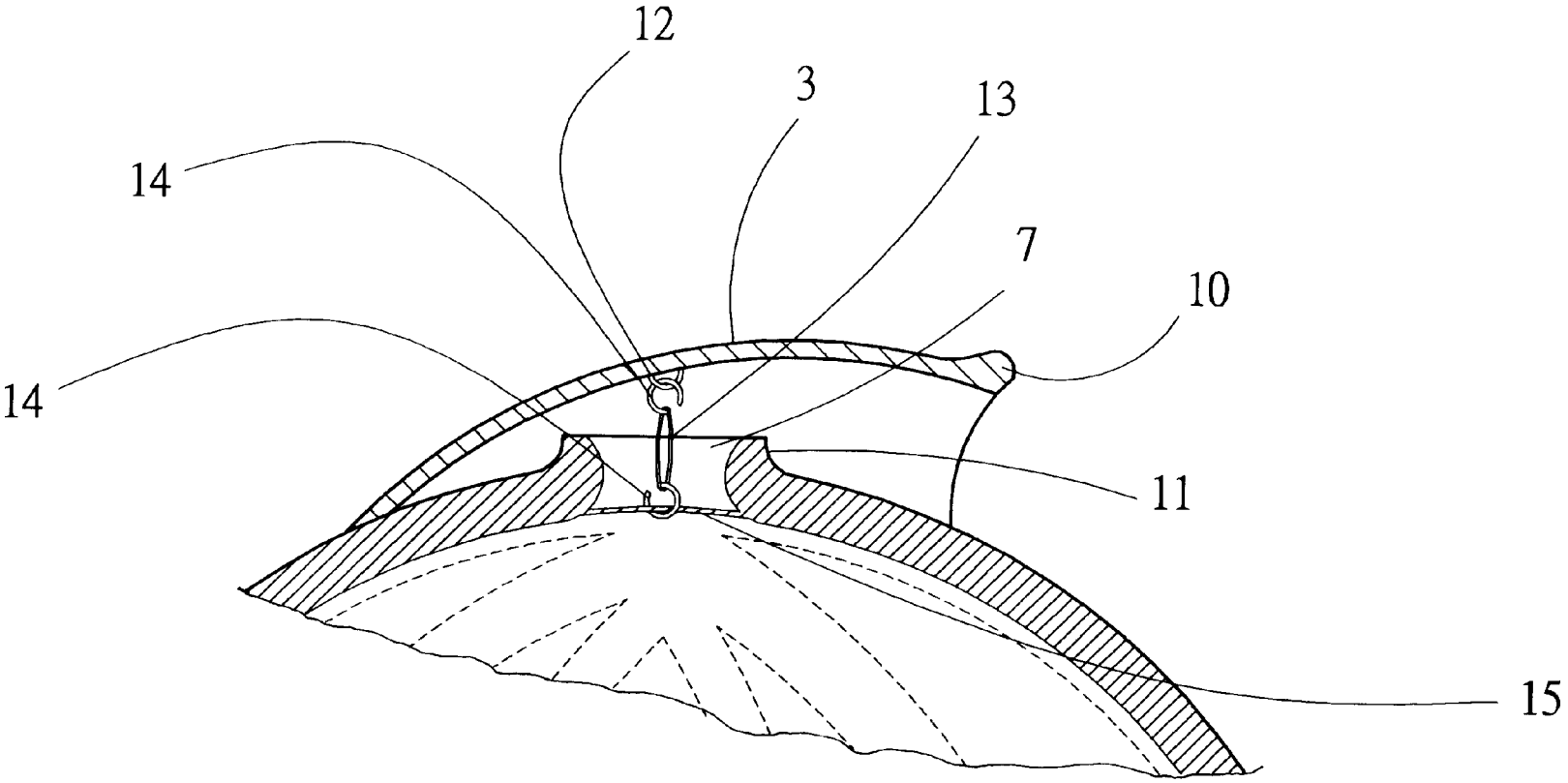
FIG. 6 shows the second preferred embodiment of the present invention in which the air funnel faces backward and is attached to the molded helmet by means of a rubber band.

FIGS. 5 and 6 show another preferred embodiment of the present invention. As seen in FIG. 5, there are a ring 12 on the inner surface of the air funnel 3 and a thin rod 15 across the conducting hole 7. There is also a rubber band 13 having hooks 14 attached to the ends thereof. When assembling the helmet, one hook 14 of the rubber band 13 is hooked onto the ring 12 and the other hook 14 is hooked to the rod 15. When it rains or is cold, a user can simply rotate the air funnel.

Figure 7:
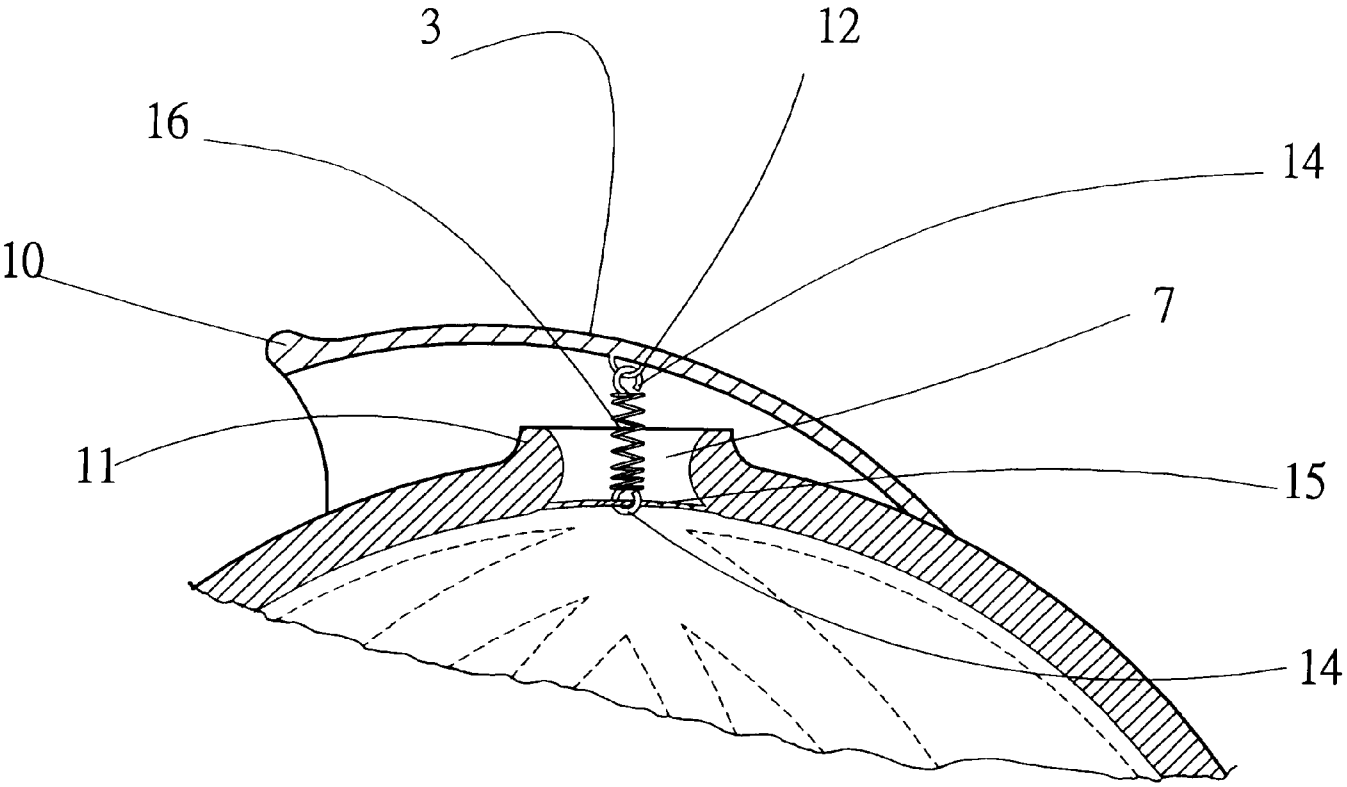
FIG. 7 shows the third preferred embodiment of the present invention in which the air funnel faces forward and is attached to the molded helmet by means of a spring.
Figure 8:
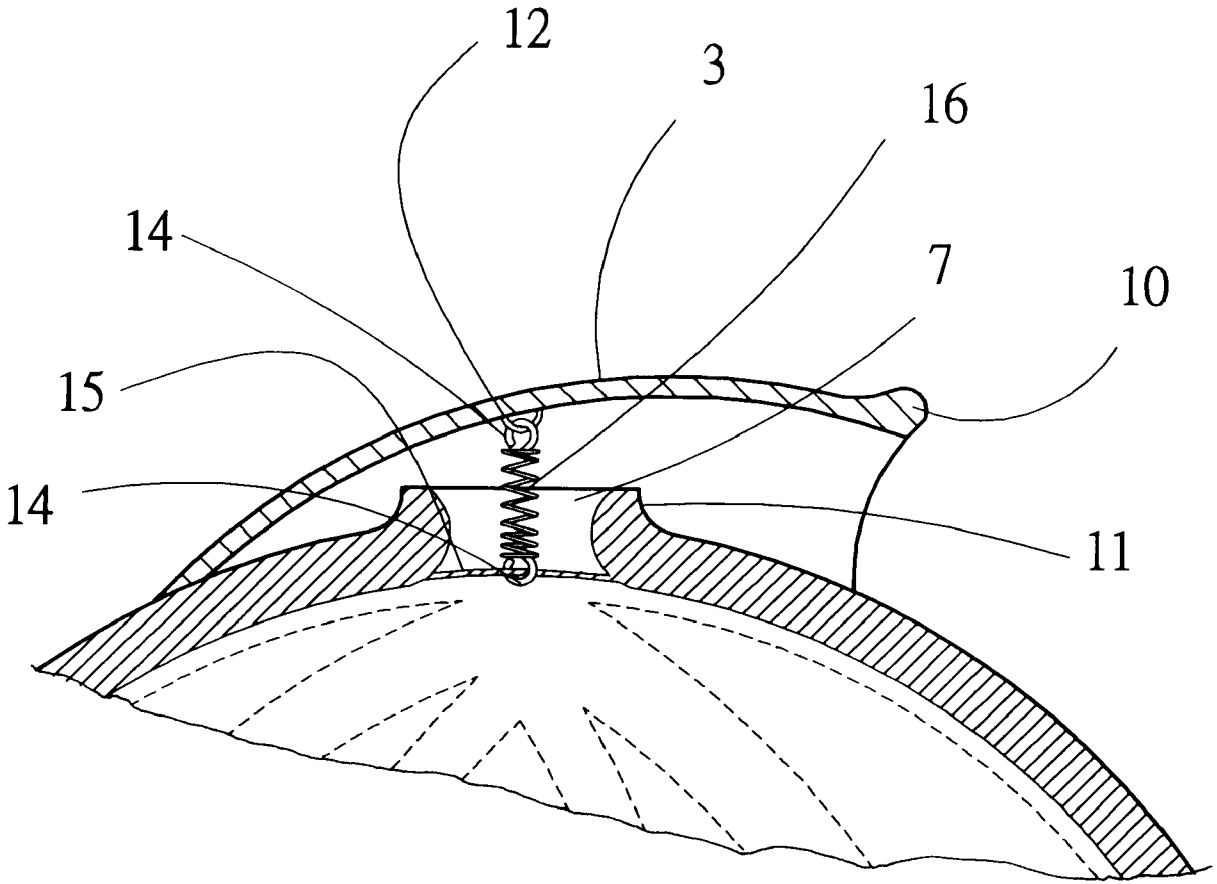
FIG. 8 shows the third preferred embodiment of the present invention in which the air funnel faces backward and is attached to the molded helmet by means of a spring.

FIGS. 7 and 8 show another preferred embodiment of the present invention. Similar to the embodiment illustrated in FIGS. 5 and 6, the rubber band 13 can be replaced with a spring 16 having hooks on the ends thereof so that the air funnel can be attached to the molded helmet similarly.

Figure 9:
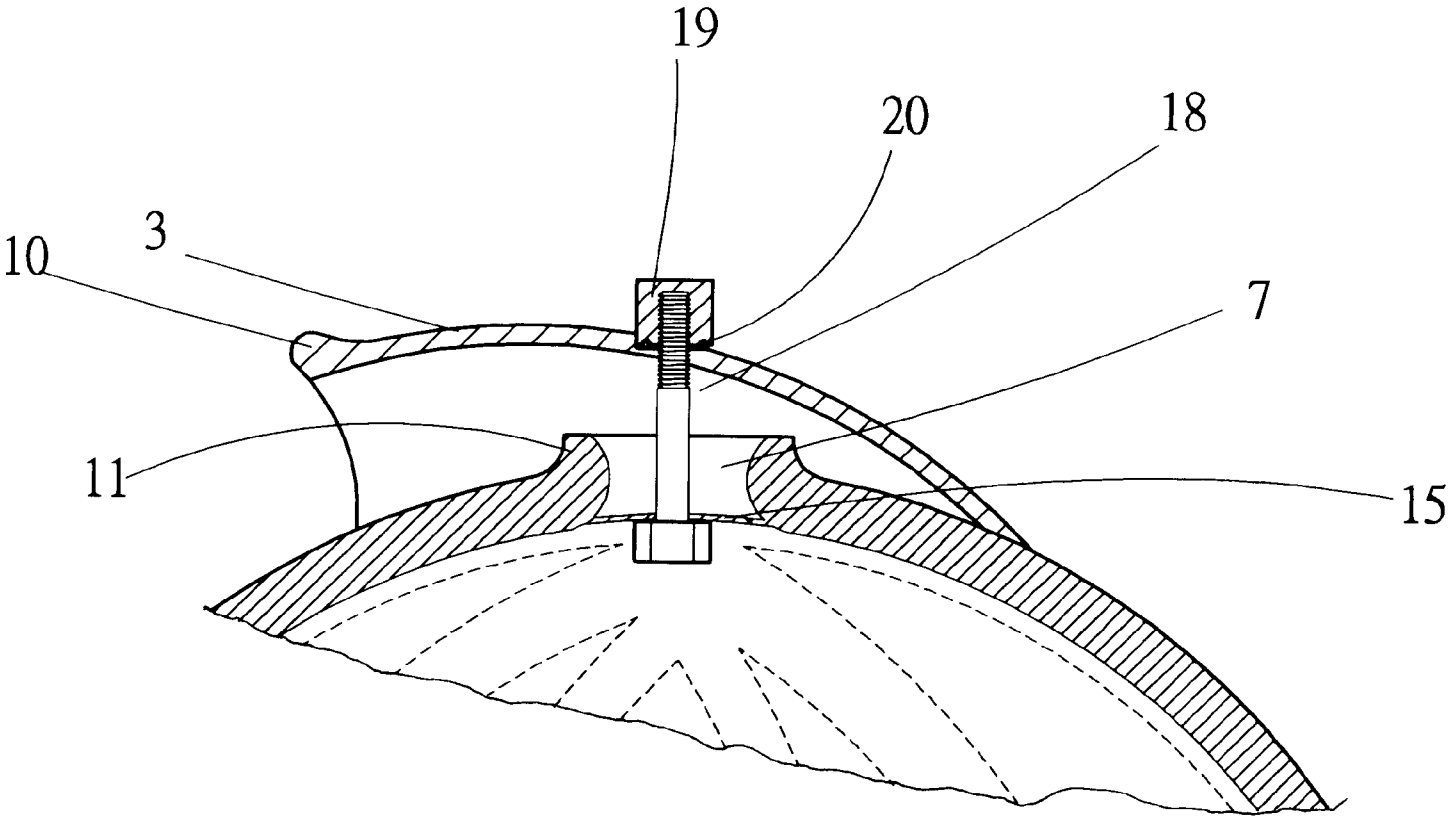
FIG. 9 shows the other preferred embodiment of the present invention in which the air funnel faces forward and is attached to the molded helmet by means of a screw and a nut.
Figure 10:
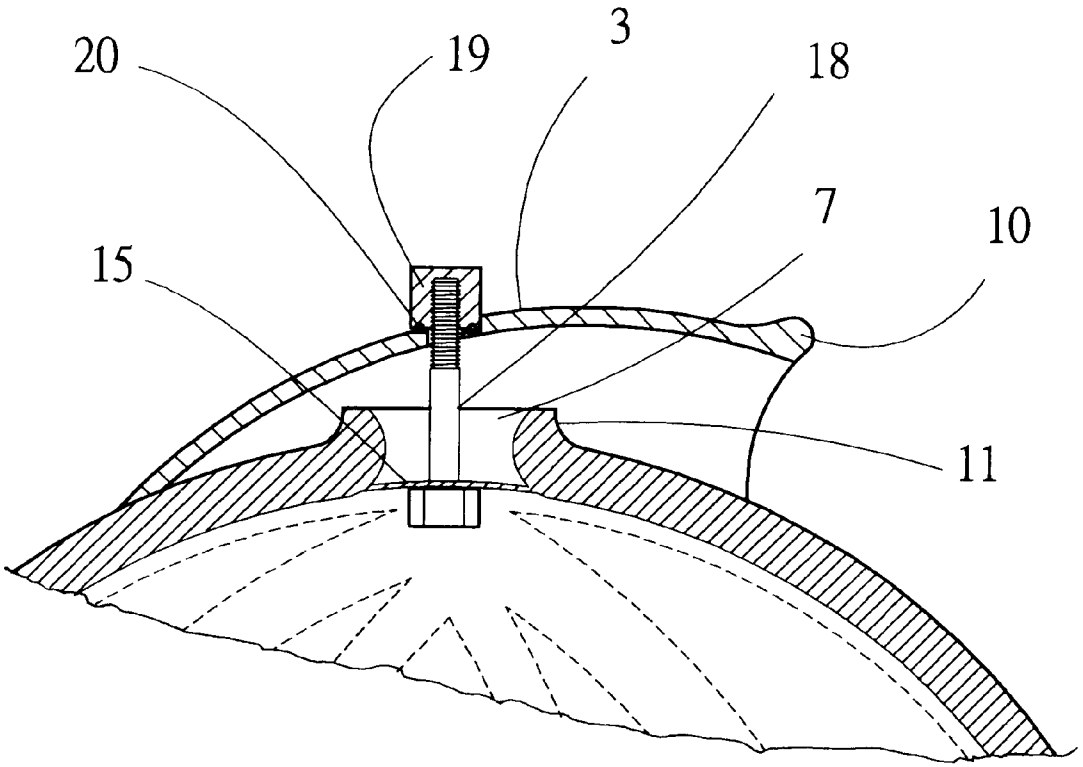
FIG. 10 shows the other preferred embodiment of the present invention in which the air funnel faces backward and is attached to the molded helmet by means of a screw and a nut.

FIGS. 9 and 10 show another preferred embodiment of the present invention. Across the conducting hole 7, a thin rod 15 is installed with a hole thereon. Further, corresponding to the hole on the rod 15, there is a hole formed on the air funnel 3. To assemble the helmet, a screw 18 extending through the holes on the rod 15 and the air funnel 3 is used in incorporation with a nut 19 to connect the air funnel 3 and the molded helmet 1. Moreover, to prevent water leakage, a washer 20 is also placed between the air funnel 3 and the nut 19. When it rains or is cold, a user can simply rotate the air funnel to prevent the cold air from flowing into the helmet.

Although the preferred embodiments have been described to illustrate the present invention, it is apparent that changes and modifications in the specifically described embodiment can be carried out without departing from the scope of the present invention. Such modifications and changes should be considered within the scope of the present invention which is intended to be limited only by the appended claims.

What is claimed is:

1. An air ventilation safety helmet comprising:

an air funnel having a front end with an air inlet, and two sides with clamping rods; and a molded helmet having an air conducting hole formed thereon and clamping grooves corresponding to said clamping rods for attaching said air funnel to said molded helmet;

wherein said air inlet and said conducting hole having flanges formed thereon for preventing water leakage.

2. The air ventilation safety helmet as claimed in claim 1, said molded helmet further comprising a liner having a plurality of air ducts formed therein, said air ducts being directed to said air conducting hole.

3. An air ventilation safety helmet comprising:

an air funnel having a front end with an air inlet, and an inner surface with a ring attached thereon;

a molded helmet having an air conducting hole and a thin rod across said air conducting hole; and an elastic element having two ends with hooks attached thereon, one end of said elastic element being hooked to said ring and the other end of said elastic element being hooked to said thin rod.

4. The air ventilation safety helmet as claimed in claim 3, said elastic element being a rubber band.

5. The air ventilation safety helmet as claimed in claim 3, said elastic element being a spring.

6. The air ventilation safety helmet as claimed in claim 3, said molded helmet further comprising a liner having a plurality of air ducts formed therein, said air ducts being directed to said air conducting hole.

7. The air ventilation safety helmet as claimed in claim 3, wherein said air inlet and said conducting hole having flanges formed thereon for preventing water leakage.

8. An air ventilation safety helmet comprising:

an air funnel having a front end with an air inlet, and a hole on top; and a molded helmet having an air conducting hole formed thereon, a thin rod across said air conducting hole, and a hole on said thin rod;

wherein said air funnel is attached to said molded helmet by a screw extended through said hole on said thin rod and said hole on said air funnel, a nut bolted on said screw, and a washer placed between said air funnel and said nut.

9. The air ventilation safety helmet as claimed in claim 8, said molded helmet further comprising a liner having a plurality of air ducts formed therein, said air ducts being directed to said air conducting hole.

10. The air ventilation safety helmet as claimed in claim 8, wherein said air inlet and said conducting hole having flanges formed thereon for preventing water leakage.

* * * * *